US007748570B2

(12) United States Patent
Bordino

(10) Patent No.: US 7,748,570 B2
(45) Date of Patent: Jul. 6, 2010

(54) REFRIGERATOR-MOUNTED HOT BEVERAGE DISPENSER

(76) Inventor: David Bordino, 382 Ridgewood Rd., Staten Island, NY (US) 10312

( * ) Notice: Subject to any disclaimer, the term of this patent is extended or adjusted under 35 U.S.C. 154(b) by 866 days.

(21) Appl. No.: 11/193,549

(22) Filed: Jul. 29, 2005

(65) Prior Publication Data

US 2007/0023451 A1 Feb. 1, 2007

(51) Int. Cl.
*B67D 5/62* (2006.01)

(52) U.S. Cl. ..... 222/146.5; 222/54; 222/81; 222/88; 222/146.1; 374/147; 374/155

(58) Field of Classification Search ..... 222/146.5, 222/81, 83, 83.5, 88, 52, 54, 146.1; 62/331, 62/390; 374/147, 148, 155
See application file for complete search history.

(56) References Cited

U.S. PATENT DOCUMENTS 2,036,618 A * 4/1936 Benjamin ..... 374/155
3,558,013 A * 1/1971 Ponzo et al. ..... 222/61
5,603,230 A * 2/1997 Tsai ..... 62/390
6,026,988 A * 2/2000 Teetsel et al. ..... 222/88
6,089,406 A * 7/2000 Feldner ..... 222/103
6,411,777 B2 * 6/2002 Roberson ..... 392/442
2003/0097314 A1 * 5/2003 Crisp et al. ..... 705/28
2006/0080991 A1 * 4/2006 An et al. ..... 62/389
2006/0283879 A1 * 12/2006 Rasmussen ..... 222/81

* cited by examiner

*Primary Examiner*—J. Casimer Jacyna
(74) *Attorney, Agent, or Firm*—Robert L. Epstein; Epstein Drangel Bazerman & James, LLP

(57) ABSTRACT

A beverage dispensing apparatus adapted for use in a refrigerator, which may comprise, inter alia, a beverage-dispensing nozzle, a perforated beverage container drain nozzle connected to the beverage-dispensing piping, an electronically actuated valve means, a beverage container holder, a thermal insulating chamber surrounding the beverage container holder, an access door for selectively providing access to the chamber, and a safety interlock switch on the access door, and electronic beverage dispenser control means and devices connected thereto.

8 Claims, 8 Drawing Sheets

20
25
26
2
15
30
35
35
50
45
91
16
65
95
70
55
75
71
11A
11B
11C
11D
81A
73
86D
81B
86C
81C
86B
81D
18
86A

REFRIGERATOR-MOUNTED HOT BEVERAGE DISPENSER

RELATED APPLICATIONS

N/A

STATEMENT OF GOVERNMENT SPONSORSHIP

None.

REFERENCE TO MICROFICHE/CD SEQUENCE LISTING, COMPUTER PROGRAM APPENDIX ETC

N/A (NONE)

BACKGROUND OF THE INVENTION

Hot beverages are desired by many people. These beverages include coffee, tea, and soup. Many persons in the United States and throughout the world consume hot beverages such as coffee and tea. Conventionally, coffee is brewed using a coffeemaker in some form, either percolator or autodrip. These machines can be time consuming and take up valuable counter space. Tea requires water to be boiled by either conventional stovetop method, or by using an autoboiler. Any advantages to time saving with using an autoboiler are diminished by the counter space it consumes. Similarly, most prepared soups require separate heating, usually on a stove or in a microwave. Like coffee and tea, soup requires preparation time.

In recent history, these manufacturers have produced ready to serve soups. These soups are marketed toward consumers that do not have the time to prepare the conventional concentrates and mixes. These ready to serve soups still require heating, which means the consumer has to take valuable time from their day to either heat the soup over the stove, or own a microwave in which to heat the soup. If prepared over the stove, the convenience provided by ready to serve soup is minimalized as such utensils as a pot and ladle are still required. This process expends excess time by creating more mess and requiring a waiting period before enjoyment. Further, the consumer is forced into making the entire container, regardless of their appetite, because these soups do not have a way in which to store excess.

Beverage dispensing directly from a refrigerator is known in the art. Many residential refrigerator models containing beverage dispenser units are currently for sale. Several patents discuss different aspects of beverage dispenser units. Historically, beverage-dispensing refrigerators have tended to focus on dispensing cool or cold beverages. However, U.S. Pat. No. 5,603,230 envisions a refrigerator door mounted beverage dispenser that dispenses hot, warm, and cold water. Also see, for example, U.S. Pat. No. 5,603,230 and US Patent Publication US2003/0097314 A1. Applicant does not know of any other apparatus which possesses all the claimed attributes and advantages of the present one.

FIELD OF THE INVENTION

This invention is in the field of refrigerator-mounted beverage dispensers. The present invention relates in general to an apparatus for a residential refrigerator that heats and dispenses fluids from a plurality of drink containers.

SUMMARY OF INVENTION

Figure 1:
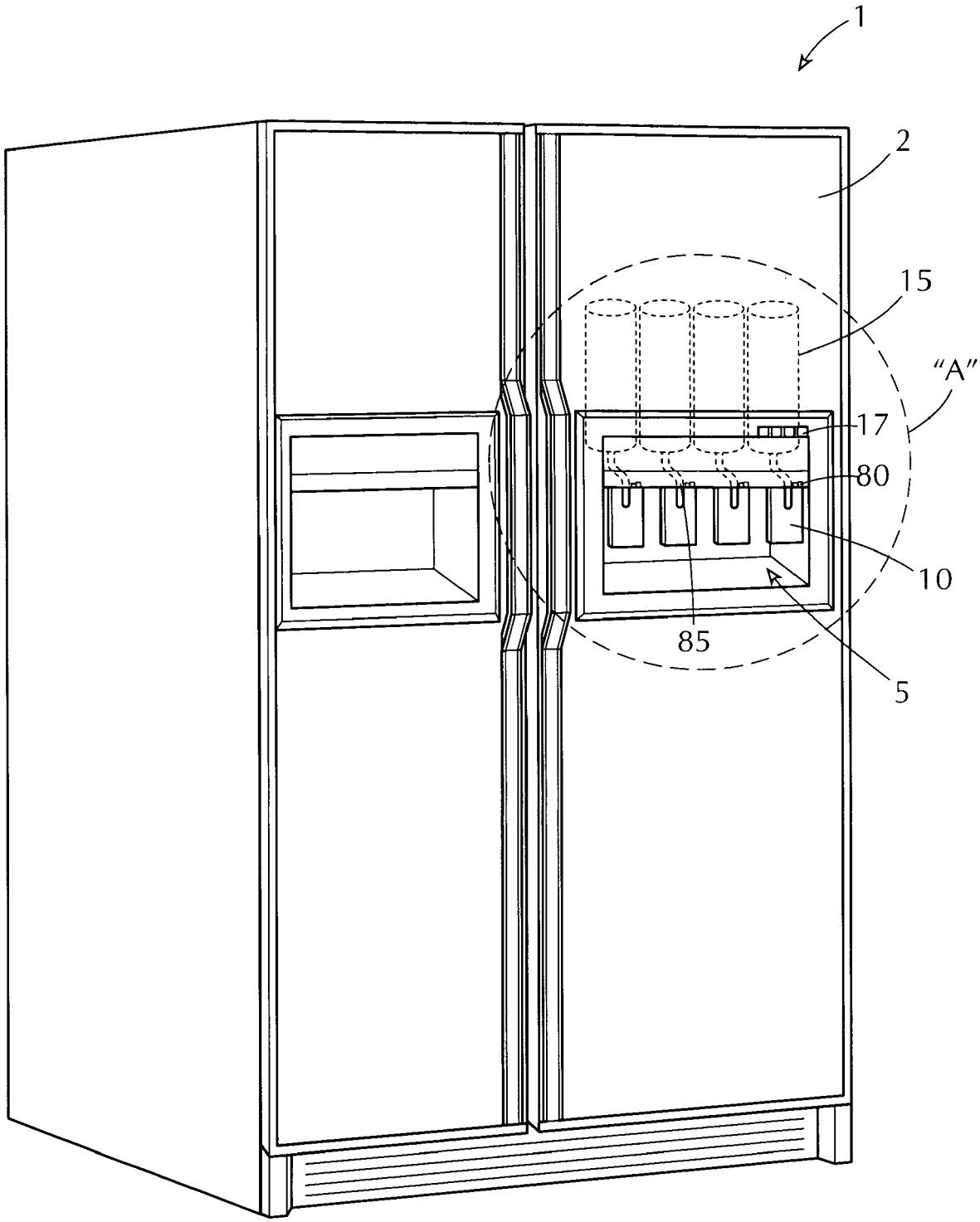
FIG. 1 shows a front perspective view of a refrigerator containing a refrigerator-mounted hot beverage dispenser apparatus "A" according to the present invention, mounted in a refrigerator constructed in accordance to one aspect of the invention.

It is the object of this invention to enable containers of various beverages, e.g. packaged coffees, teas, cappuccinos, and, as well as soups and hot, liquid foods to be dispensed through a refrigerator, and preferably through an apparatus that is disposed in a refrigerator door (or otherwise attached to a refrigerator).

This invention allows for eliminating the need for bulky machines as coffeemakers and autoboilers, while providing the convenience of instantly-available coffee, tea, soup and various other hot beverages. This is preferably accomplished by a dispenser located in a refrigerator door.

In accordance with one aspect of the invention, there is provided a beverage dispensing apparatus adapted for use in a refrigerator, e.g. in a refrigerator door. The apparatus may accept containers of beverages to be dispensed, and may include, without limitation, a beverage-dispensing nozzle, which is connected to beverage dispensing piping, connected to a perforated beverage container drain nozzle having associated piercing means for piercing into a beverage container, such that beverage may flow out of the container and ultimately be dispensed from the beverage dispensing nozzle. In accordance with another aspect of the invention, there may be a valve means, which may be electronically actuated, disposed along the beverage dispensing piping between the beverage dispensing nozzle and the perforated beverage container drain nozzle. Coaxially mounted upon perforated beverage container drain nozzle may be a beverage container holder, which will hold the beverage containers which are, essentially, impaled upon the perforated beverage container drain nozzle, and upon its associated piercing means. In accordance with yet another aspect of the invention, the beverage container holder is surrounded by a thermal insulating chamber, which itself may be selectively accessed by an access door which may have a safety interlock switch operably connected to it, so that when access door is closed, the safety interlock switch is also closed, thereby permitting the apparatus to function, and when the access door is open, the safety interlock switch is also open, thereby preventing the function of apparatus.

In accordance with yet another aspect of the invention, there may be an electronic beverage dispenser control means (which may comprise a microprocessor and assorted data processing means, all of which are well-known to those of ordinary skill in the relevant arts), to which are operatively connected devices which may include, but are not limited to, a beverage selector means (e.g., a button), beverage heating means (e.g. electrical heating wires in thermal contact with the beverage container and/or the beverage dispenser piping, as an electrical in-line heater), beverage presence sensor means (e.g. a pressure sensor or electrical conductivity sensor); a beverage temperature sensor means (e.g. a thermistor); beverage dispensing switch means, electronically actuated valve means, safety interlock means, beverage dispenser status indicator means (e.g. a lamp).

In accordance with yet another aspect of the invention, the perforated beverage container drain nozzle may be essentially integrated with a beverage exhaustion sensor means, and/or the temperature sensor means.

In accordance with yet another aspect of the invention, the electronic beverage dispenser control means may be configured such that when said beverage presence sensor reads positive (indicating beverage is in the container into which the sensor and associate drain nozzle have pierced), the beverage heating means are enabled, but when the beverage presence sensor reads negative, the beverage heating means are disabled. The beverage temperature sensor and the beverage heating means may be operably connected to the electronic beverage dispenser control means, which may be configured so as to (electrically) drive the beverage heating means with a duty cycle appropriate to heat the beverage to a desired temperature.

In accordance with yet another aspect of the invention, the electronically actuated valve means is normally closed when deenergized, and is normally open when energized. In the presently preferred embodiment of the invention, the electronically actuated valve means are open, and beverage is dispensed, only when the following conditions exist: (i) beverage selector means are engaged, (ii) beverage dispensing switch means are engaged; (iii) beverage temperature sensor means register a desired temperature; (iv) beverage presence sensor means read positive; (v) safety interlock switch means are engaged.

In accordance with yet another aspect of the invention, the beverage dispenser status indicator means may indicate at least one condition selected from the following list: beverage selector means status, beverage dispensing switch means status, beverage temperature sensor means status, beverage presence sensor means status, and safety interlock switch means status.

DETAILED DESCRIPTION OF THE PRESENTLY PREFERRED EMBODIMENT

Reference is now made to FIG. 1, which depicts a Refrigerator 1 having a refrigerator door 2 having a recessed compartment 5. Recess compartment 5 is the location of the apparatus "A" according to the present invention. Also visible in FIG. 1 are the push plate beverage selection switch 10, beverage container holder 15, keypad 17, beverage selector button 80, and beverage dispenser status indicator lamp 85. (Note that herein "wire" may mean a multi-strand cable, i.e. at least one of a plurality of separate wire strands, though referred to as a wire and drawn as a single line)

Figure 2:
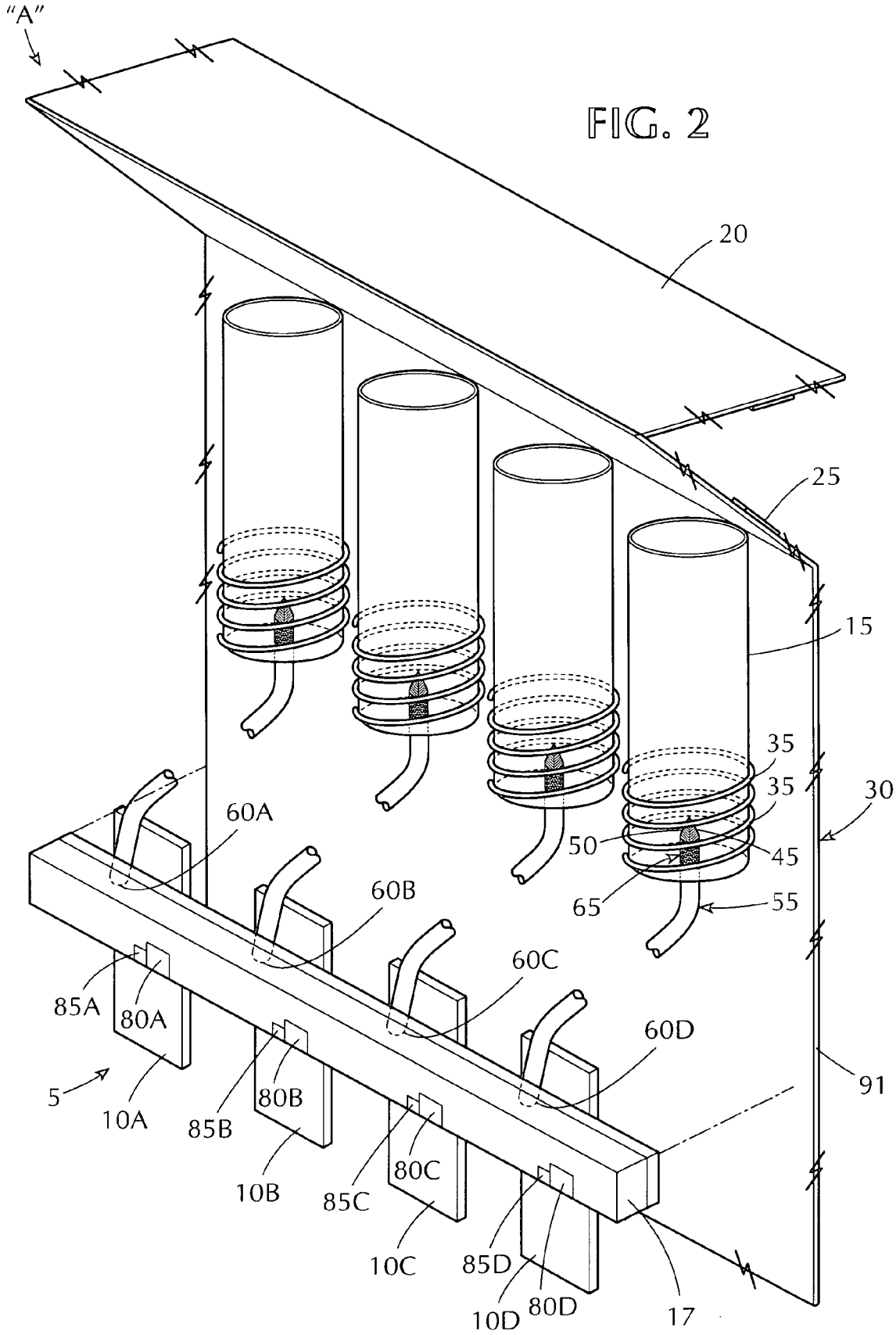
FIG. 2 is a Side perspective sectional view of part of FIG. 1, showing in close-up the apparatus "A" of FIG. 1.

Reference is now made to FIG. 2. which depicts certain parts discussed in connection with FIG. 1, and others. Access door 20, operably connected to safety interlock switch 25, provides access to thermal insulating chamber 30, into which beverage container 40 may be disposed. Also provided are beverage heating means 35, shown disposed as helical wires, but which may also be inline heating means (not shown for clarity) in the flow path. Also depicted are beverage temperature sensor 45 and beverage presence sensor 50, both mounted atop perforated beverage container drain nozzle 65. In a presently preferred embodiment, piercing means 47 may comprise beverage temperature sensor 45 and may also comprise beverage presence sensor 50. Beverage dispensing piping 55 is also shown, as are beverage dispensing nozzles 60A-D. FIG. 2 also depicts beverage selector button 80, beverage dispensing indicator lamp 85, and insulating walls 91.

Reference is now made to FIG. 3, which depicts, inter alia, safety interlock wire 26 connecting to electronic beverage dispensing control means 73. Beverage heating means wire connecting to electronic beverage dispensing control means 73. Beverage temperature sensor 45 is connected, via beverage temperature sensor wire 46, to electronic beverage dispensing control means 73. Beverage presence sensor 50 is connected, via beverage presence sensor wire 51, to electronic beverage dispensing electronic beverage dispensing control means 73. Beverage temperature sensor 45 and beverage presence sensor 50 comprise the piercing means 47. Beverage heating means 35 is connected, via beverage heating means wire 18 (which like some other wires, is a cable providing both power and control signals), to electronic beverage dispensing control means 73.

Figure 3A:
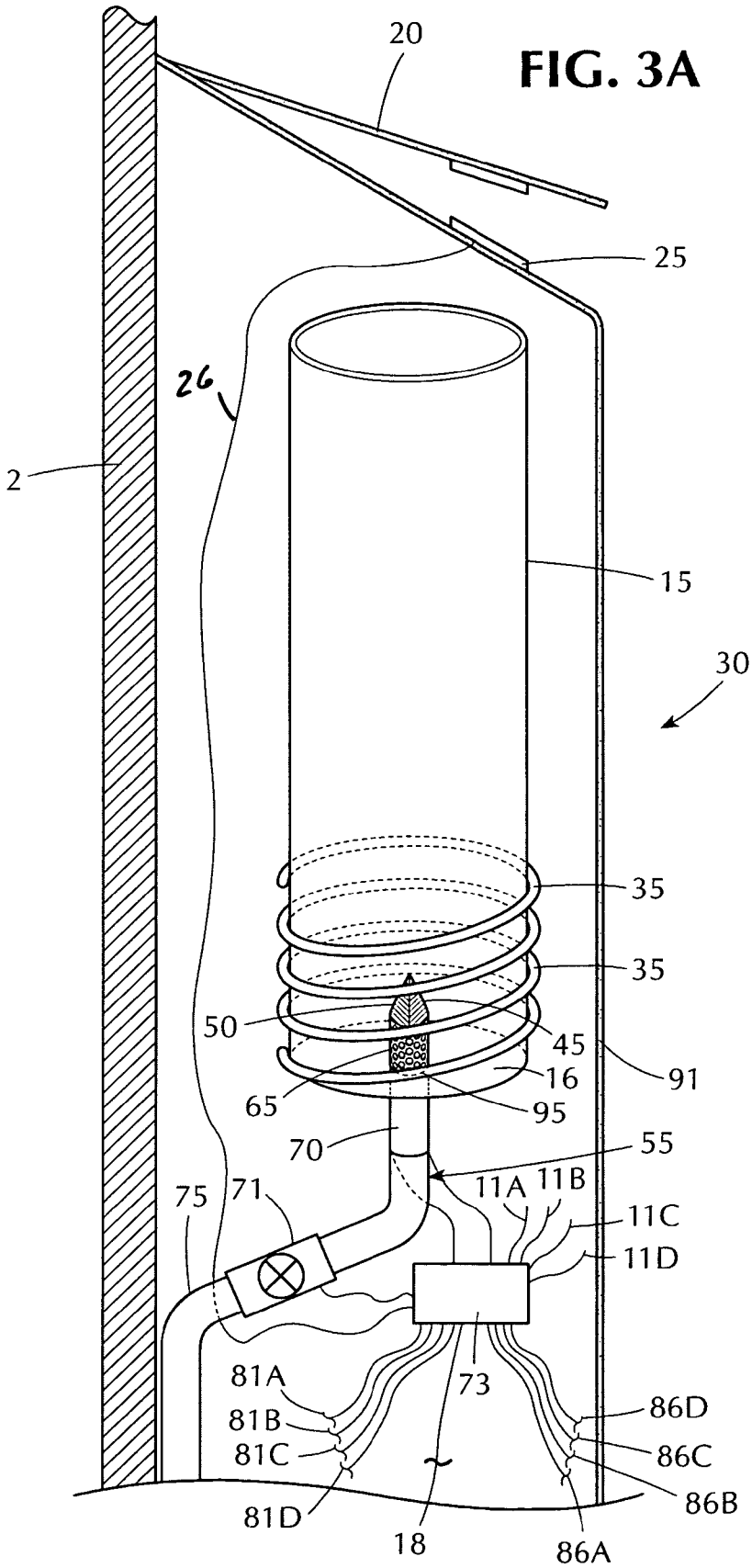
FIG. 3A is a side view of the apparatus "A" of FIG. 2.

Continuing to refer to FIG. 3A, beverage dispensing piping 55 is connected to perforated beverage container drain nozzle 65 via coupling 70. In line on that piping/beverage path is electronically actuated valve means 71, which are connected via electronically actuated valve means wire 72 to electronic beverage dispensing control means 73. Also operably connected to the electronic beverage dispensing control means 73 are beverage selector button wires 81 A-D, the other ends of which are each connected to their corresponding push plate switch product selector switches 10 A-D. Also connected to the electronic beverage dispensing control means 73 are Indicator lamp wires 86 A-D, the other end of each is connected to the corresponding one of beverage dispenser status indicator means 80 A-D.

Figure 3B:
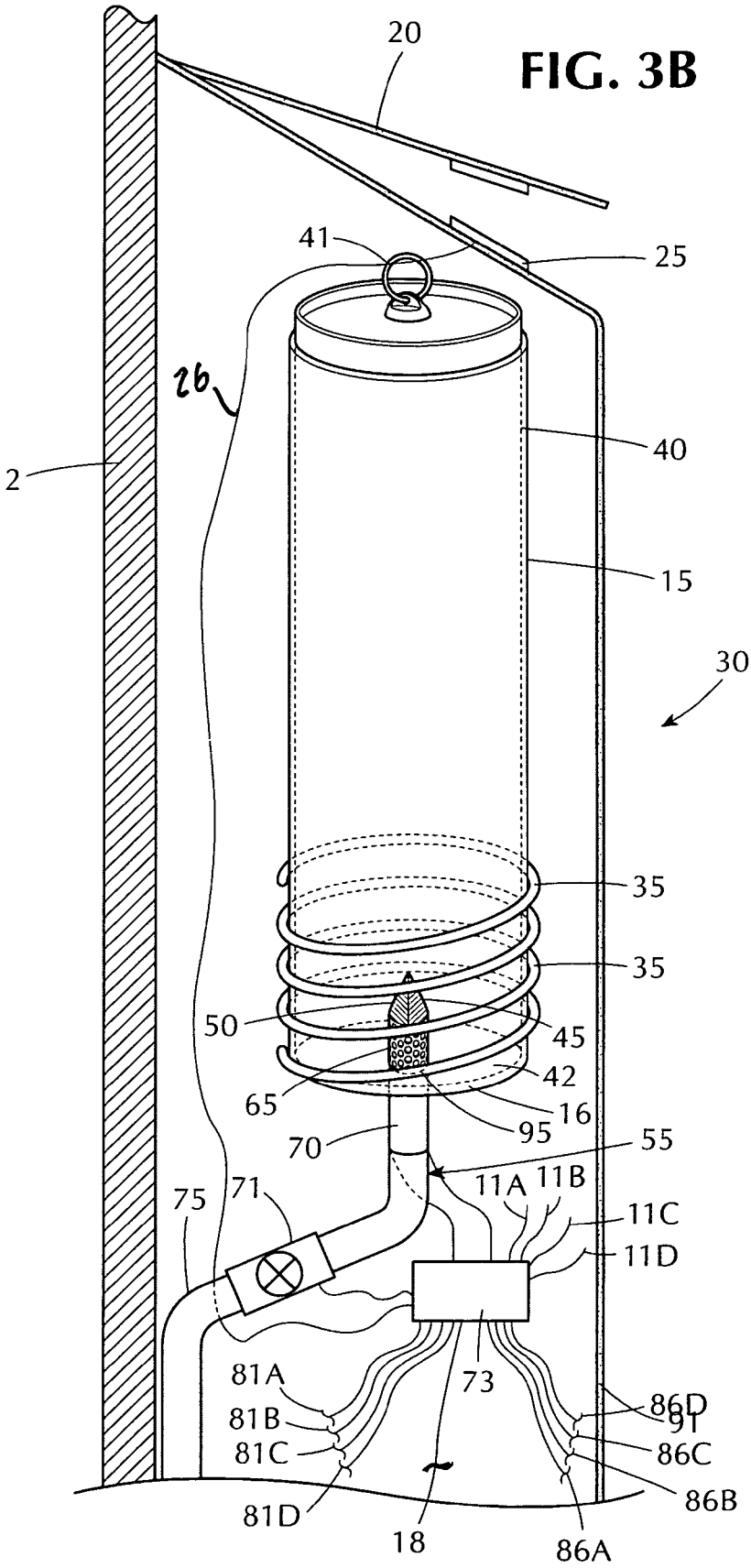
FIG. 3B is similar to FIG. 3A, except that beverage container has been inserted into apparatus "A".
Figure 3C:
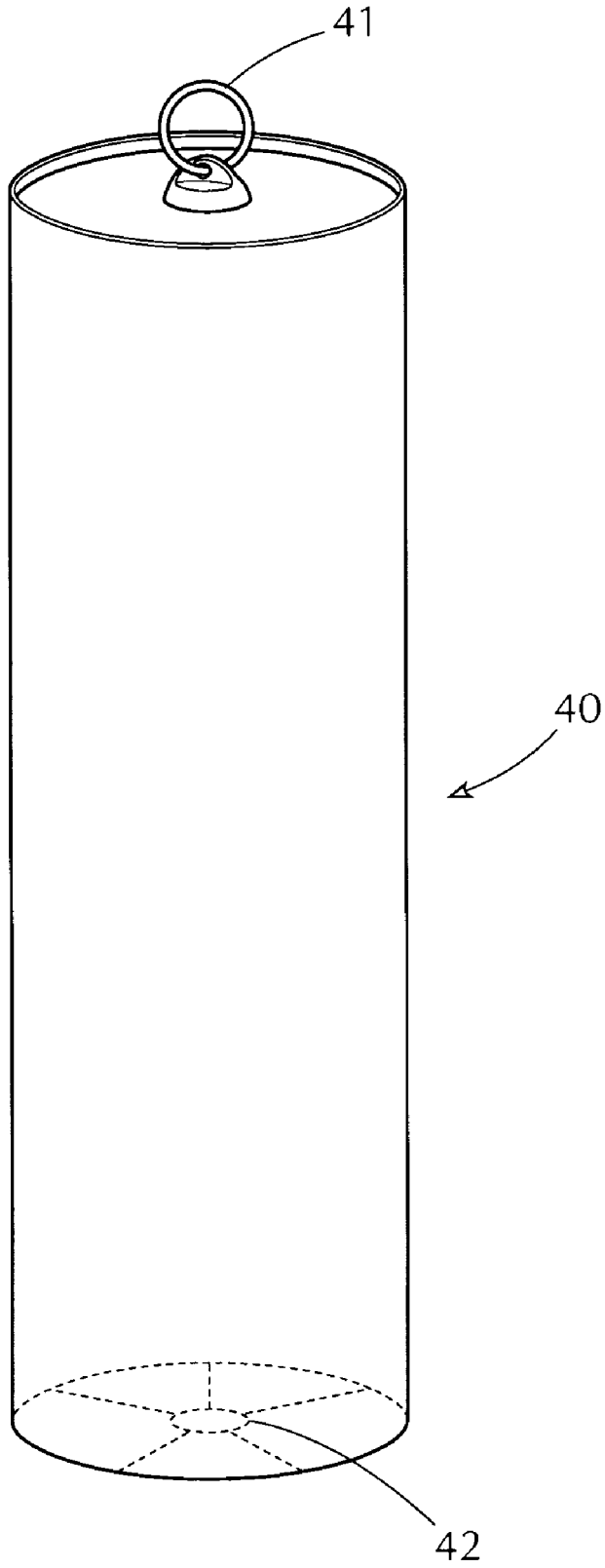
FIG. 3C is a close-up of the beverage container depicted in FIG. 3B.

Better visible in FIG. 3B is the coupling 70 of piping and perforated beverage container drain nozzle 65, and beverage container 40. Reference is now made to FIG. 3C, which depicts beverage container 40, which in a presently preferred embodiment is substantially cylindrical in shape, and which is liftable by pull ring 41 and pierceable in its pierceable bottom 42. The piercing means 47 of the perforated beverage drain nozzle 65, upon inserting beverage container 40 into beverage container holder 15, would within the beverage container 40, perforated beverage drain nozzle 65 comprises a plurality of circular perforations 66.

Figure 4A:
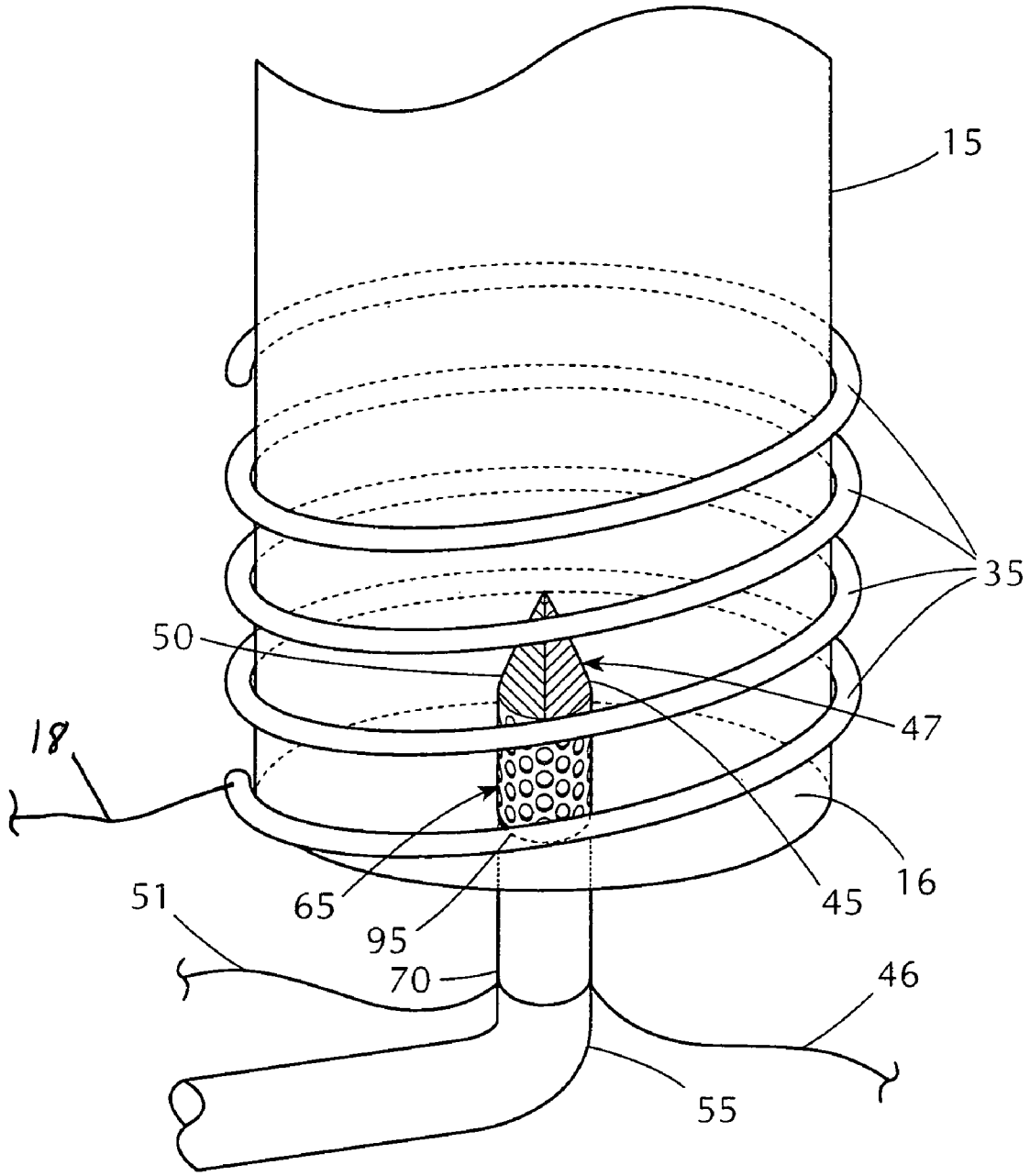
FIG. 4A is a detail close up of the perforated drain nozzle of FIG. 3A.
Figure 4B:
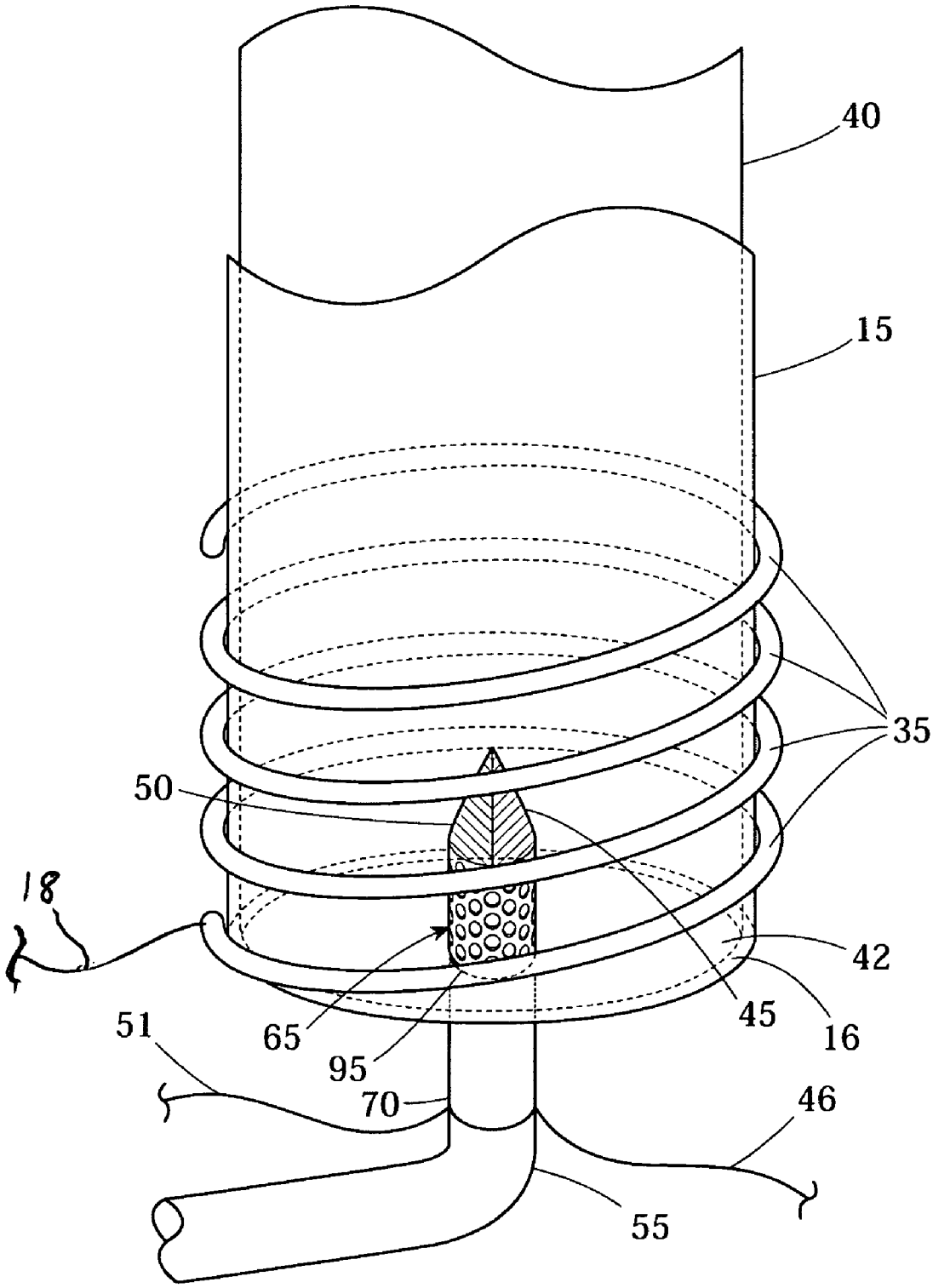
FIG. 4B is similar to FIG. 4A except that beverage container has been inserted into apparatus "A", with detail close up of the perforated drain nozzle of FIGS. 3A and 3B.

Reference is now made to FIG. 4A, which depicts beverage container holder 15 and the bottom 16 of beverage container holder 15, which, in a presently preferred embodiment, is helically encircled by beverage heating means 35 (which could, as a simple design choice, be embedded wholly or partially in beverage container holder 15, or located wholly or partially inside beverage heating container holder 15.) Note that both beverage temperature sensor 45 and beverage presence sensor 50 are connected to electronic beverage dispenser control means 73 via beverage temperature sensor wire 46 and beverage presence sensor wire 51, respectively, and that piercing means 47 are, in a presently preferred embodiment, comprised of beverage temperature sensor 45 and beverage presence sensor 50. Note also that piercing means 47 is located above perforated beverage container drain nozzle 65, which extends into beverage container holder 15 so that (as seen in FIG. 4B, beverage container 40 may be impaled thereon, making it possible to drain the beverage contents (not shown, for clarity) of beverage container 40. Note that FIG. 3C also shows coupling 70 and point of connection between perforated beverage container drain nozzle.

Figure 5:
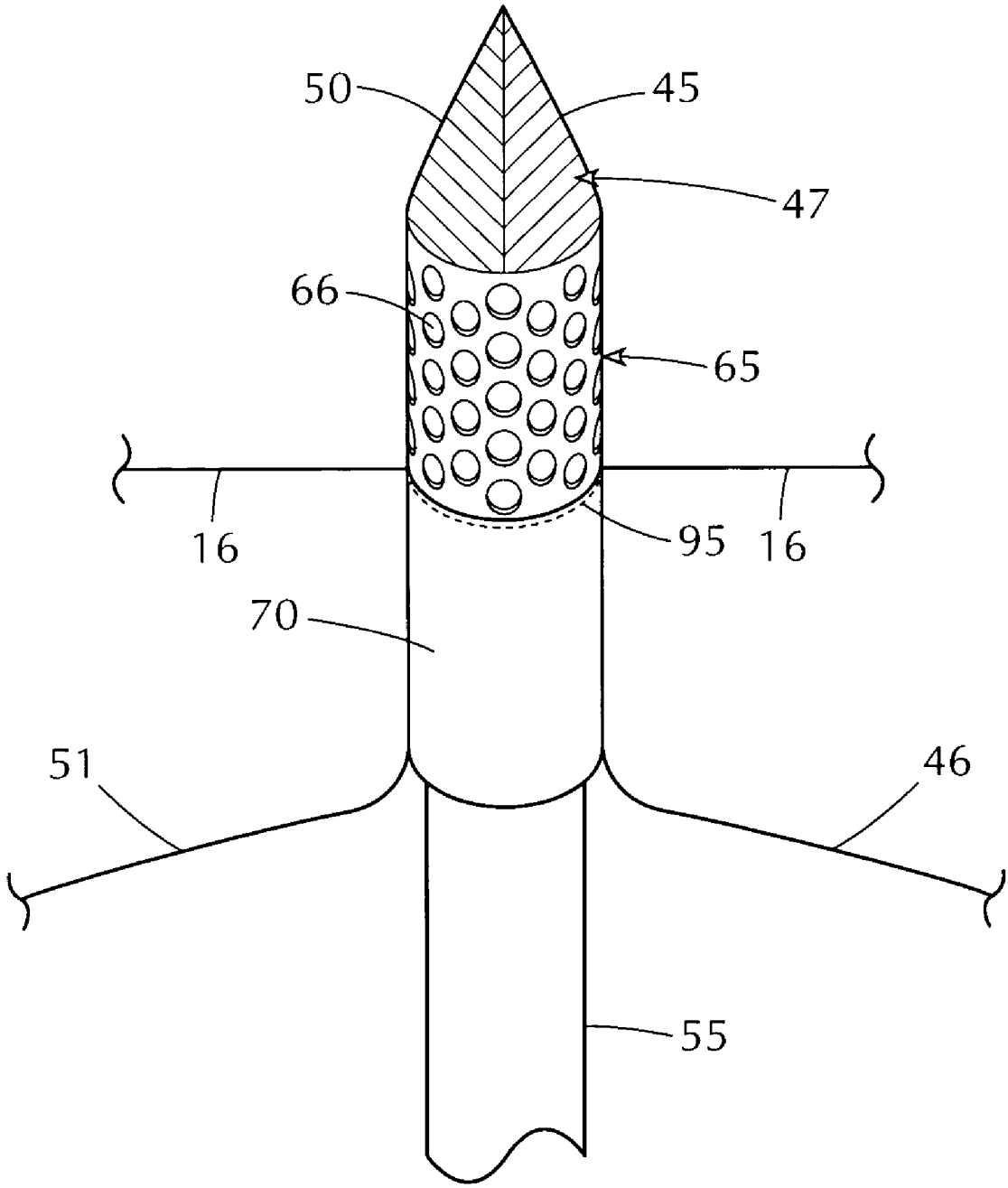
FIG. 5 is fragmentary view of perforated drain nozzle, shown in close up, and also illustrating the plane the beverage container bottom rests on, and also the sensor means and wiring therefore.

Reference is now made to FIG. 5, showing in more close-up the perforated beverage container drain nozzle 65 (having a plurality of perforations 66) and its surrounding structure.

The invention claimed is:

1. A refrigerator capable of dispensing a heated beverage through an outlet from a beverage container having a bottom, said refrigerator comprising a thermal insulating chamber, a holder situated within said chamber and adapted to receive a beverage container therein, a heating means wire surrounding at least a portion of said holder adapted when energized to heat a beverage in a container received within said holder, control means for electrically energizing said heating means wire, drain means comprising piercing means extending into said holder for piercing the bottom of a beverage container received in said holder and conducting the beverage from said container to the outlet, and beverage temperature sensing means situated within said piercing means and operably connected to cause said control means to deenergize said heating means wire when the temperature of the beverage is sensed to be above a desired temperature and further comprising means situated in said piercing means for sensing the presence of a beverage.

2. The refrigerator of claim 1 wherein said beverage presence sensing means is operably connected to said control means.

3. The refrigerator of claim 1 wherein said drain means comprises a pipe extending from said piercing means to the outlet.

4. The refrigerator of claim 3 further comprising valve means situated in said pipe and operably connected to be regulated by said control means.

5. A refrigerator capable of dispensing first and second heated beverages through outlet means from separate beverage containers, each of which has a bottom, said refrigerator comprising a thermal insulating chamber, first and second holders situated within said chamber each adapted to receive a different beverage container therein, first and second heating means wires each surrounding at least a portion of a different one of said containers, control means for selectively electrically energizing said first and second heating means wires, first and second drain means extending into said first and second holders, respectively, each comprising means for piercing the bottom of a container received in the associated holder and conducting the beverage from said container to the outlet means, and first and second temperature sensing means situated within said first and second piercing means, respectively, each of said temperature sensing means being operably connected to said control means to cause said control means to deenergize the heating means wire associated with the holder having piercing means with temperature sensing means that senses a beverage temperature above a desired temperature, and means for selecting a beverage to be dispensed through the outlet means and further comprising separate means situated in each of said piercing means respectively for sensing the presence of a beverage.

6. The refrigerator of claim 5 wherein each of said beverage presence sensing means is operably connected to said control means.

7. The refrigerator of claim 5 wherein each of said drain means comprises a pipe connecting a different one of said piercing means to the outlet means and comprising a valve associated with each of said pipes regulated by said control means.

8. The refrigerator of claim 7 further comprising means for selectively activating each of said valves.

* * * * *